US008469149B2

(12) United States Patent
Meillet et al.

(10) Patent No.: US 8,469,149 B2
(45) **Date of Patent: *Jun. 25, 2013**

(54) SELF-RETRACTING LIFELINE WITH DISCONNECTABLE LIFELINE

(75) Inventors: Vincent G. Meillet, Cannes la Bocca (FR); Scott C. Casebolt, St. Paul Park, MN (US)

(73) Assignee: D B Industries, LLC, Red Wing, MN (US)

( * ) Notice: Subject to any disclaimer, the term of this patent is extended or adjusted under 35 U.S.C. 154(b) by 249 days.

This patent is subject to a terminal disclaimer.

(21) Appl. No.: 12/795,167

(22) Filed: Jun. 7, 2010

(65) Prior Publication Data

US 2011/0297778 A1 Dec. 8, 2011

(51) Int. Cl.
*A62B 1/00* (2006.01)

(52) U.S. Cl.
USPC ..... 182/230; 242/378.2; 182/3

(58) Field of Classification Search
USPC ..... 242/378.2–378.3; 182/232, 237, 182/3, 230
See application file for complete search history.

(56) References Cited

U.S. PATENT DOCUMENTS

| | | | | |
|---|---|---|---|---|
| 2,329,943 | A * | 9/1943 | Robins | 242/587.1 |
| 3,100,323 | A * | 8/1963 | Baker | 403/353 |
| 3,602,483 | A * | 8/1971 | Russell et al. | 182/239 |
| 3,836,123 | A * | 9/1974 | Bausenbach et al. | 242/157.1 |
| 4,081,219 | A | 3/1978 | Dykmans | |
| 4,832,392 | A * | 5/1989 | Butler | 294/82.12 |
| 4,877,110 | A | 10/1989 | Wolner | |
| 5,125,628 | A * | 6/1992 | Rempinski et al. | 254/323 |
| 5,251,877 | A * | 10/1993 | Rempinski et al. | 254/323 |
| 5,312,061 | A | 5/1994 | McCormick | |
| 5,762,282 | A | 6/1998 | Wolner | |
| 5,816,109 | A | 10/1998 | Dege | |
| 6,019,304 | A | 2/2000 | Skowronski et al. | |
| 6,119,544 | A | 9/2000 | Cebollero | |
| 6,629,511 | B2 * | 10/2003 | De Bien | 119/776 |
| 6,742,819 | B2 | 6/2004 | So et al. | |
| 6,776,554 | B2 | 8/2004 | Acciacca | |

(Continued)

FOREIGN PATENT DOCUMENTS

| | | |
|---|---|---|
| DE | 201 08 777 U1 | 9/2001 |
| FR | 1208895 | 2/1960 |
| FR | 2 927 778 | 8/2009 |
| WO | WO 01/90598 | 11/2001 |
| WO | WO 2008/008225 A2 | 1/2008 |
| WO | WO 2008/019354 A2 | 2/2008 |
| WO | WO 2009/047470 A1 | 4/2009 |

OTHER PUBLICATIONS

"APTURA™ LT30 Self-Retracting Lanyard", http://msafallprotection.com/product16592.html, MSA The Safety Company, 2 pages (Known of prior to filing of U.S. Appl. No. 12/751,386. Printed Sep. 17, 2010) (© MSA 2010).

(Continued)

*Primary Examiner* — Katherine Mitchell
*Assistant Examiner* — Daniel Cahn
(74) *Attorney, Agent, or Firm* — IPLM Group, P.A.

(57) ABSTRACT

A self-retracting lifeline is provided. In one embodiment, the self-retracting lifeline includes a housing, a drum, an activation assembly, a lifeline and a connector, the drum is received in the housing. The activation assembly is received in the housing. Moreover, the activation assembly is operationally coupled to the drum to selectively rotate the drum. The connector is coupled proximate an end of the lifeline. The connector has a connector passage. The connector passage is configured and arranged to selectively couple the lifeline to the drum.

6 Claims, 15 Drawing Sheets

U.S. PATENT DOCUMENTS

| | | | | |
|---|---|---|---|---|
| 6,810,997 | B2 | 11/2004 | Schreiber et al. | |
| 6,837,126 | B2 | 1/2005 | Matsuo | |
| 7,108,248 | B2 | 9/2006 | Winter et al. | |
| 8,226,024 | B2 * | 7/2012 | Meillet | 242/380 |
| 2005/0039981 | A1 | 2/2005 | Wooster et al. | |
| 2005/0048827 | A1 | 3/2005 | Curry et al. | |
| 2005/0126857 | A1 * | 6/2005 | Hamada | 182/231 |
| 2007/0215410 | A1 | 9/2007 | Ecker | |
| 2008/0035423 | A1 | 2/2008 | Meillet et al. | |
| 2008/0247828 | A1 * | 10/2008 | Craig et al. | 405/259.1 |
| 2009/0084631 | A1 | 4/2009 | Casebolt | |
| 2009/0084883 | A1 * | 4/2009 | Casebolt et al. | 242/389 |
| 2010/0224448 | A1 * | 9/2010 | Wolner et al. | 182/234 |
| 2011/0084158 | A1 * | 4/2011 | Meillet et al. | 242/385.4 |
| 2011/0240403 | A1 * | 10/2011 | Meillet | 182/3 |

OTHER PUBLICATIONS

"APTURA™ LT30 Self-Retracting Lanyard [Advanced Performance Technology]", ID 2300-69/Apr. 2004, MSA (FP), 4 pages (© MSA 2004).

"Instructions for Field Line Replacement on the APTURA™ LT12 SRL", Bulletin 2301-30, MSA (FP), 1 page (© MSA 2003).

"APTURA™ LT30 Self-Retracting Lanyard (SRL) Features & Benefits", 2301-54, MSA (FP), 1 page (© MSA 2004).

"ANSI Z359-Compliant Products from MSA", ID 2302-29-MC/Dec. 2008, MSA The Safety Company, 12 pages (© MSA 2008).

"APTURA™ LT12 Self Retracting Lanyard User Instructions for Field Line Replacement", P/N 10044813, MSA (FP), 8 pages (© 2003 MSA).

"APTURA™ LT12 Self Retracting Lanyard [Advanced Performance Technology]", ID 2300-51, Rev. A/Feb. 2003, MSA (FP), 4 pages (© 2003 MSA).

U.S. Appl. No. 12/751,333, filed Mar. 31, 2010, D B Industries, Inc.

U.S. Appl. No. 12/751,353, filed Mar. 31, 2010, D B Industries, Inc.

U.S. Appl. No. 12/751,386, filed Mar. 31, 2010, D B Industries, Inc.

International Search Report of PCT/US2011/035536 mailed Sep. 27, 2011.

* cited by examiner 300
310
306
304
312
332
330
308

300
320b
320
325
323
306
320c
321o
321
320d
320a
310
316
312
314
332
330

300
302
312
332
330
306
304
310
354
308

310
304
306
332
308
312
330

310
320a
320b
320
331
323
332
319
320c
321
320d
314
330
312
325
329

302
312
330
304
306
332
310
308

SELF-RETRACTING LIFELINE WITH DISCONNECTABLE LIFELINE

BACKGROUND

Various occupations place people in precarious positions at relatively dangerous heights thereby creating a need for fall arrest, fall protection, and rescue equipment. Among other things, such equipment usually includes a lifeline interconnected between a support structure and a person working in proximity to the support structure. The lifeline is typically secured to a full-body safety harness worn by the user.

Self-retracting lifelines are commonly used by workers performing tasks during which there is a risk a fall may occur. A self-retracting lifeline generally includes a housing containing a drum around which a lifeline such as cable, rope, or webbing is wound. The drum is spring biased to pay out the lifeline as tension pulling the lifeline is applied and to retract the lifeline that has been unwound from the drum as the tension on the lifeline is reduced or released. The housing also includes a brake assembly for stopping rotation of the drum when the lifeline suddenly unwinds from the drum at a rate greater than a predetermined maximum angular velocity.

A self-retracting lifeline is typically connected to a support structure within the vicinity the worker is performing the task, and an end of the lifeline is typically connected to a safety harness worn by the worker. The lifeline is easily drawn out of the self-retracting lifeline housing as the worker moves away from the device, and the lifeline is automatically drawn back into the housing as the worker moves toward the device. Should a fall occur, the brake assembly within the device is automatically engaged by a centrifugal clutch assembly, which gradually and quickly stops the worker's fall by gradually and quickly stopping the rotation of the drum. As the rotation of the drum is stopped, additional lifeline is prevented from being paid out of the housing to stop the fall of the worker.

A self-retracting lifeline could also include a retrieval assembly, which retracts or pays out the lifeline of the self-retracting lifeline, to raise or lower the worker to a safe location should a fall occur.

Through use, the lifeline can become worn, and the integrity of the self-retracting lifeline can become compromised therefore compelling replacement of the lifeline to optimize safety. Some self-retracting lifelines require that the entire device be sent in for repair to replace the lifeline while some self-retracting lifelines are "field-replaceable" because the lifelines can be replaced by the worker.

For the reasons stated above and for other reasons stated below, which will become apparent to those skilled in the art upon reading and understanding the present specification, there is a need in the art for a self-retracting lifeline with a disconnectable lifeline.

SUMMARY OF INVENTION

The above-mentioned problems of current systems are addressed by embodiments of the present invention and will be understood by reading and studying the following specification. The following summary is made by way of example and not by way of limitation. It is merely provided to aid the reader in understanding some of the aspects of the invention.

In one embodiment, a self-retracting lifeline is provided. The self-retracting lifeline includes a housing, a drum, an activation assembly, a lifeline and a connector. The drum and activation assembly are received in the housing. Moreover, the activation assembly is operationally coupled to the drum.

The connector is coupled proximate an end of the lifeline. The connector has a connector passage. The connector passage is configured and arranged to selectively couple the lifeline to the drum.

In another embodiment, a self-retracting lifeline that includes a housing, a drum, an activation assembly, a stop connector and a pawl is provided. The drum and the activation assembly are received in the housing. The activation assembly is operationally coupled to the drum. The stop connector is coupled proximate an end of the lifeline. The pawl is configured and arranged to selectively engage the stop connector to selectively couple the lifeline to the drum.

In still another embodiment, another self-retracting lifeline that includes a lifeline, a stop connector, a housing, a drum and an activation assembly is provided. The stop connector is coupled proximate an end of the lifeline. The drum is received in the housing. The drum includes a first disk member, a second disk member and a mid-member. The mid-member is positioned between the first disk member and the second disk member. The mid-member has a receiving slot that is configured and arranged to selectively hold the stop connector to selectively couple the lifeline to the drum. The second disk member has a slot passage that is aligned with the receiving slot of the mid-member. The slot passage allows access to the stop connector positioned in the receiving slot. The activation assembly is also received in the housing and is operationally coupled to the drum.

BRIEF DESCRIPTION OF THE DRAWINGS

The present invention can be more easily understood and further advantages and uses thereof more readily apparent, when considered in view of the detailed description and the following figures in which:

FIG. 10D is an exploded side perspective view drum of FIG. 10B further including a lifeline;

In accordance with common practice, the various described features are not drawn to scale but are drawn to emphasize specific features relevant to the present invention. Reference characters denote like elements throughout Figures and text.

DETAILED DESCRIPTION

In the following detailed description, reference is made to the accompanying drawings, which form a part hereof, and in which is shown by way of illustration specific embodiments in which the inventions may be practiced. These embodiments are described in sufficient detail to enable those skilled in the art to practice the invention, and it is to be understood that other embodiments may be utilized and that changes may be made without departing from the spirit and scope of the present invention. The following detailed description is, therefore, not to be taken in a limiting sense, and the scope of the present invention is defined only by the claims and equivalents thereof.

Figure 2:
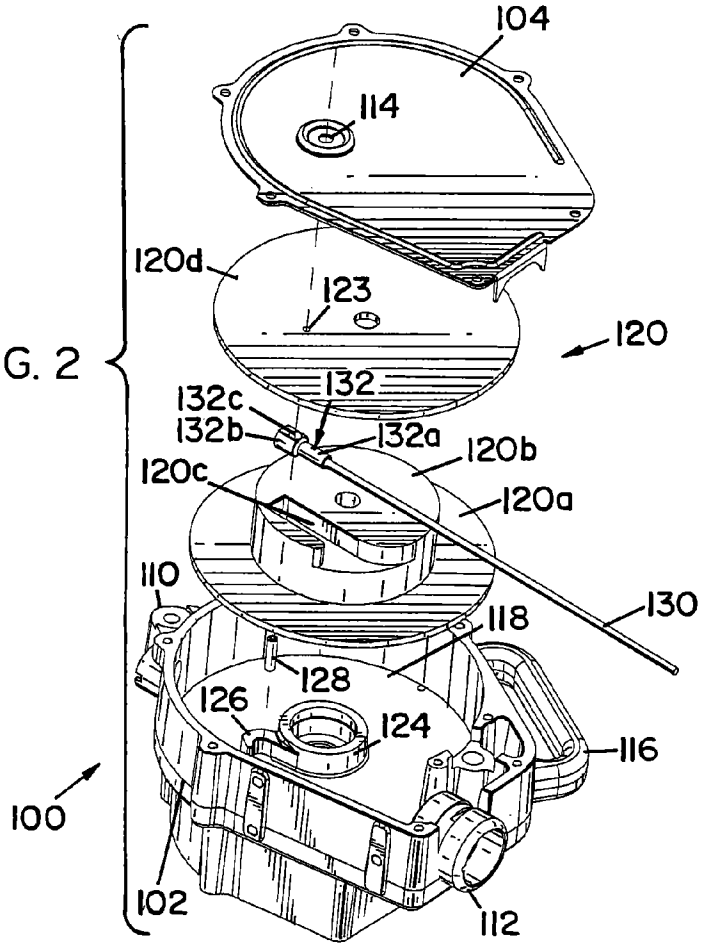
FIG. 2 is a front perspective unassembled view of the self-retracting lifeline of FIG. 1.
Figure 1:
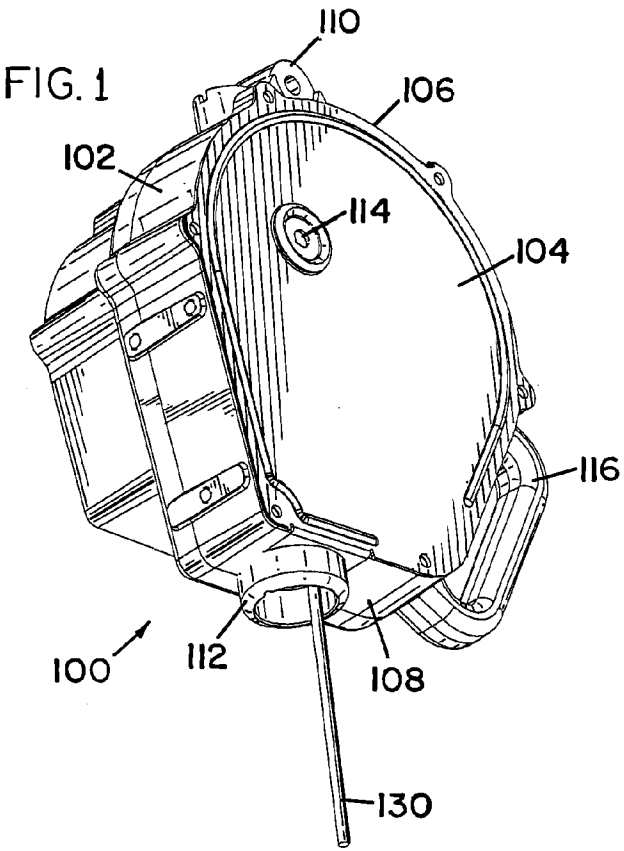
FIG. 1 is a front perspective assembled view of self-retracting lifeline.

Embodiments of the present invention provide a self-retracting lifeline with a detachable lifeline. Hence, if a lifeline of a self-retracting lifeline of embodiments of the present invention becomes worn it can be replaced with a new lifeline. Referring to FIG. 1, a front perspective view of a self-retracting lifeline 100 of one embodiment is illustrated. The self-retracting lifeline 100 includes a housing 102 and a housing cover 104. The housing 102 has a top portion 106 and a bottom portion 108. A connecting portion 110 is coupled to the top portion 106 of the housing. The connecting portion 110 is used to couple the self-retracting lifeline 100 to a support structure. The bottom portion 108 of the housing 102 includes a cable guide 112. Cable guide 112 includes an opening in which a lifeline 130 is received in the housing 102. The housing 102 in this embodiment also includes a handle 116. FIG. 2 illustrates the self-retracting lifeline 100 partially unassembled. As illustrated, the housing 102 includes a cavity 118. Inside the cavity 118 is received a first activation member 124 and a second activation 126. The first activation member 124 and the second activation member 126 are rotationally coupled to an activation assembly that is received in an activation portion 138 of the self-retracting lifeline 100. The activation assembly includes the drum bias device (such as a motor spring) and braking device known in the art and briefly discussed above in the background section.

Further received in cavity 118 of housing 102 is drum 120. Drum 120 includes a first disc member 120*a*, a second disc member 120*d* and a mid-member 120*b*. The mid-member 120*b* is coupled between the first disc member 120*a* and the second disc member 120*d*. The mid-member 120*b* of the drum 120 includes a slot 120*c* that is formed proximate the second disc member 120*d*. Slot 120*c* is designed to receive an end of a lifeline 130. In particular, in this embodiment, a connector 132 coupled proximate an end of the lifeline 130 is received in the slot 120*c* of the mid-member 120*b* of the drum 120. The connector 132, in the embodiment shown, includes a neck 132*a* that is coupled proximate the end of the lifeline 130 and a head 132*b*. The head 132*b* includes a connection aperture 132*c*. A set screw 128 is selectively received in the connection aperture 136*c* to selectively couple the connector 132 of the lifeline 130 in the slot 120*c* of the mid-member 120*b* of the drum 120. Although, 128 is described as a set screw any type of fastener that fulfills the same function can be used.

Figure 4A:
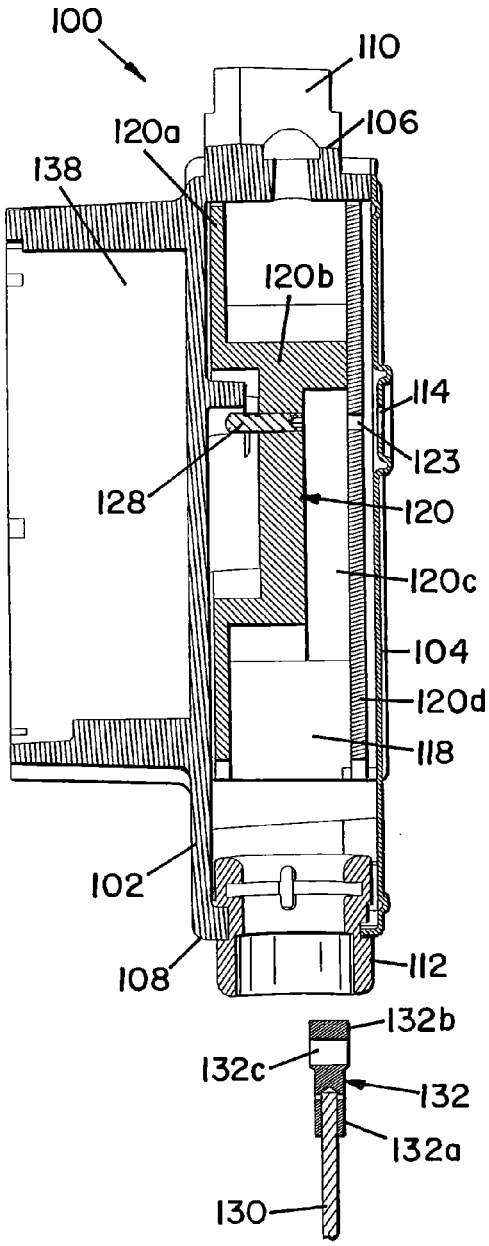
FIGS. 4A through 4C are cross-sectional side views of the self retracting lifeline of FIG. 1 along line AA of FIG. 3.
Figure 3:
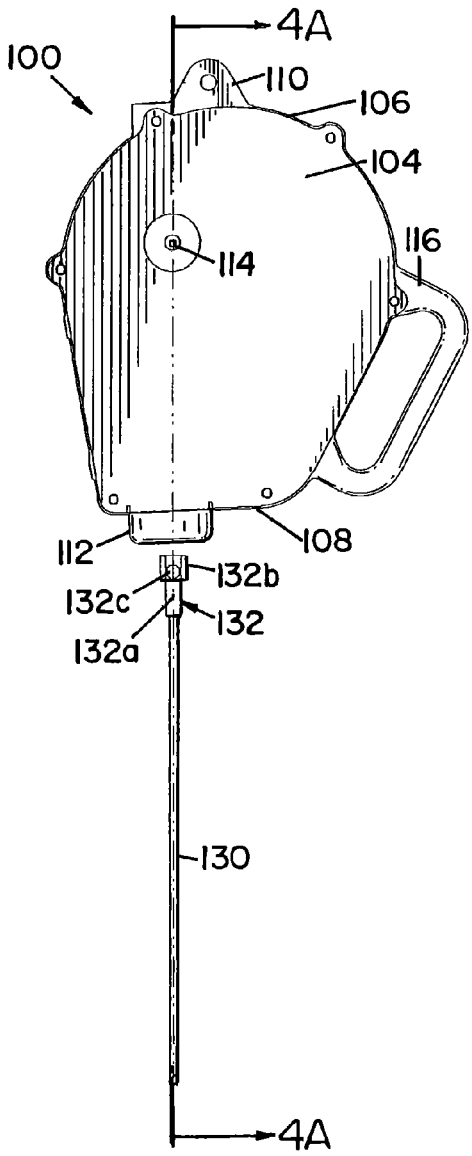
FIG. 3 is a front view of the self-retracting lifeline of FIG. 1.
Figure 4C:
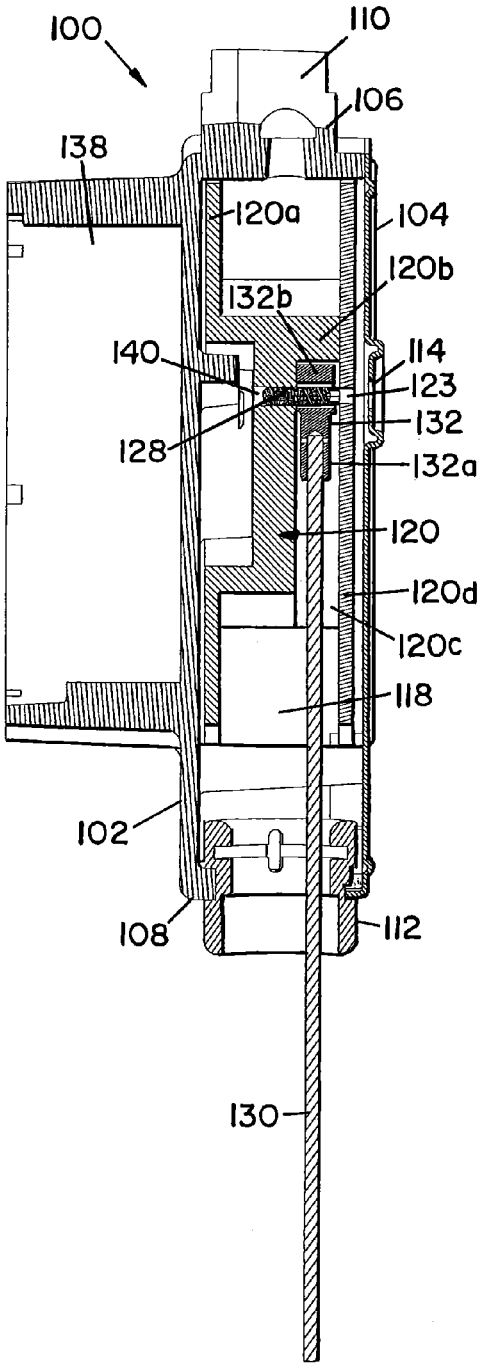
Figure 4B:
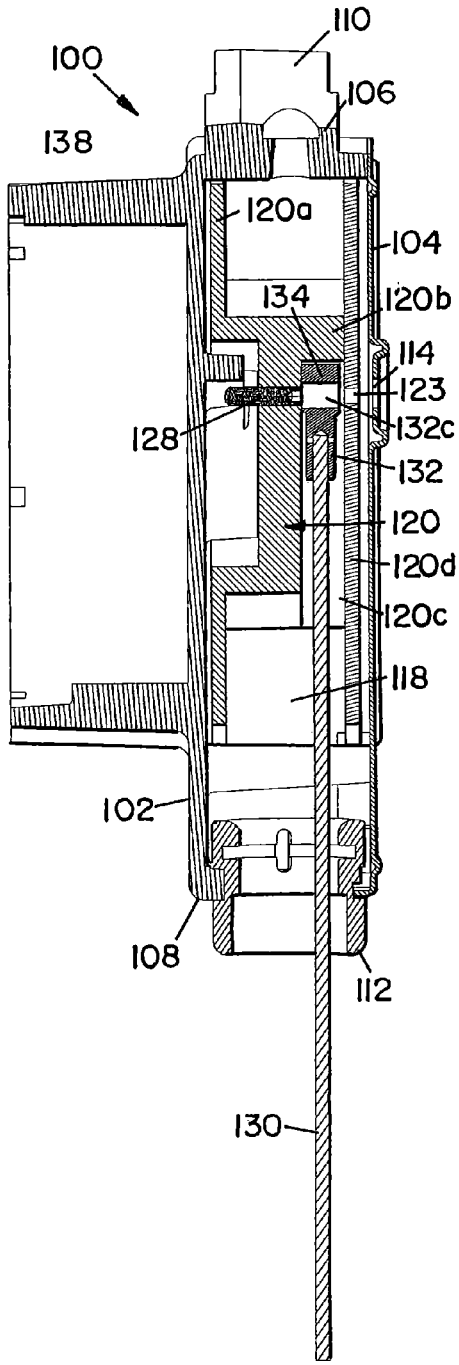

FIG. 3 illustrates a front view of the self-retracting lifeline 100 with the lifeline 130 being aligned to be received in the housing 102 of the self-retracting lifeline 100. Referring to FIG. 4A, a cross-sectional side view of the self-retracting lifeline 100 along line AA of FIG. 3 is illustrated. As illustrated, the connector 132 coupled proximate the end of the lifeline 130 is aligned with a passage in the cable guide 112 so it can be passed into slot 120*c* of drum 120. Also illustrated in FIG. 4A is the position of the set screw 128. The set crew 128 in this position provides a clear passage for the connector 132 to be received in the slot 120*c*. Further the set screw 128 in this position, engages the second activation member 126 to prevent rotation of the drum 120. An activation head of the set screw 128 is aligned with a second disc access aperture 123 in the second disc 120*d* and a cover access aperture 114 in the cover 104. Further illustrated in FIG. 4A is the activation portion 138 of the self-retracting lifeline 100. The activation portion 138 of the self-retracting lifeline 100 is operationally coupled to the drum 120 to selectively pay out, retract and stop a pay out of a lifeline 130 as known in the art. The cross-sectional side view of FIG. 4B illustrates the connector 132 that is coupled to the end of the lifeline 130 being positioned in slot 120*c* of the drum 120. As illustrated, the connector passage 132*c* of the connector 132 is aligned with the set screw 128 on one side and the second disc access aperture 123 and the cover access aperture 114 on the other side. The cross-sectional side view of FIG. 4C illustrates the set screw 128 being adjusted in a threaded bore 140 of the drum 120 such that the set screw 128 is received in the connector passage 132*c* of the connector 132. This configuration selectively couples the lifeline 130 to the drum 132.

Figure 5B:
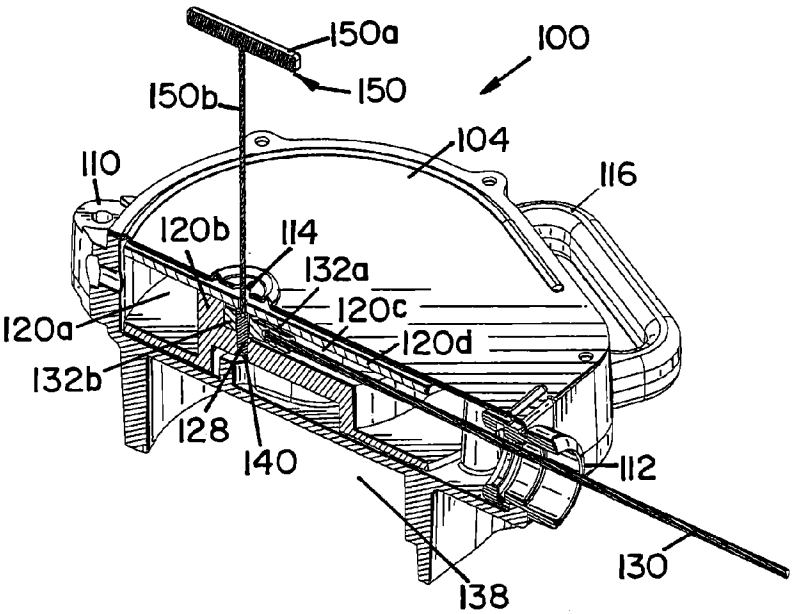
FIG. 5B is a cross-sectional view of the self-retracting lifeline of FIG. 1 and the application of the tool of FIG. 5A.
Figure 5A:
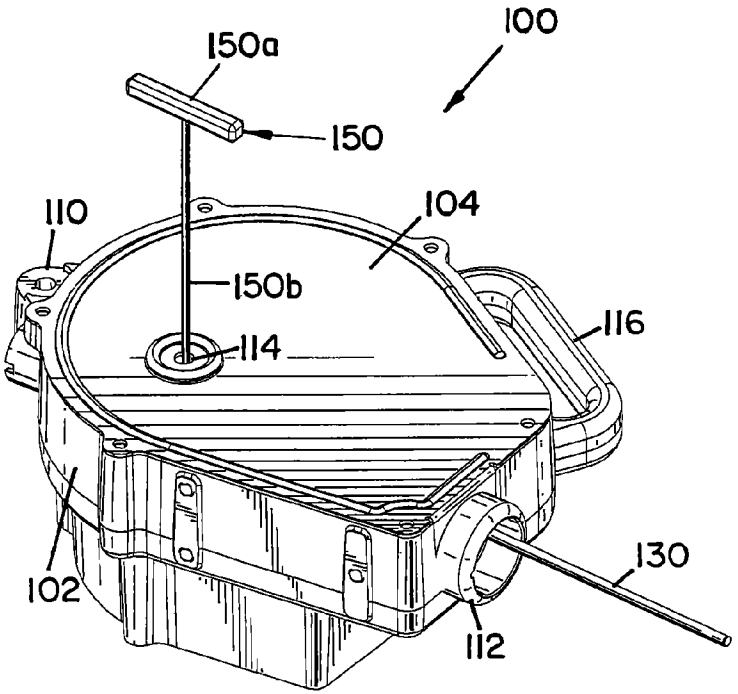
FIG. 5A is a front perspective view of the self-retracting lifeline of FIG. 1 and the application of a tool of an embodiment of the present invention.

The front perspective view of the self-retracting lifeline 100 in FIG. 5A and the cross-sectional front view of the self-retracting lifeline 100 in FIG. 5B illustrates a tool 150 used to manipulate the set screw 128 to selectively lock the lifeline 130 to the drum 120. In particular the tool 150 includes a manipulation handle 150*a* and a tool shaft 150*b*. The manipulation handle 150*a* allows a user to easily twist the tool shaft 150*b*. As illustrated in the cross-sectional view of FIG. 5B, an end of the tool shaft 150*b* engages the manipulation end the set screw 128. In particular the tool shaft 150*b* extending through the cover access 114, the second disc access aperture 123, and through the connector passage 132*c* engages the set screw 128 to manipulate the set screw 128 in relation to the threaded bore 140. Therefore, in this embodiment, to replace a lifeline 130, the tool 150 is used to manipulate the set screw 128 until it is no longer in the connector passage 132*c* of the connector 132. The old lifeline 130 can then be removed from the housing 102 of the self-retracting lifeline 100. A new lifeline 130 is positioned in the slot 120*c* of the drum 120 and the tool 150 is used to manipulate the set screw 128 once again to position the set screw 128 within the connector passage 132*c* of the new lifeline 130 to connect the new lifeline 130 to the drum 120 of the self-retracting lifeline 100.

Figure 6:
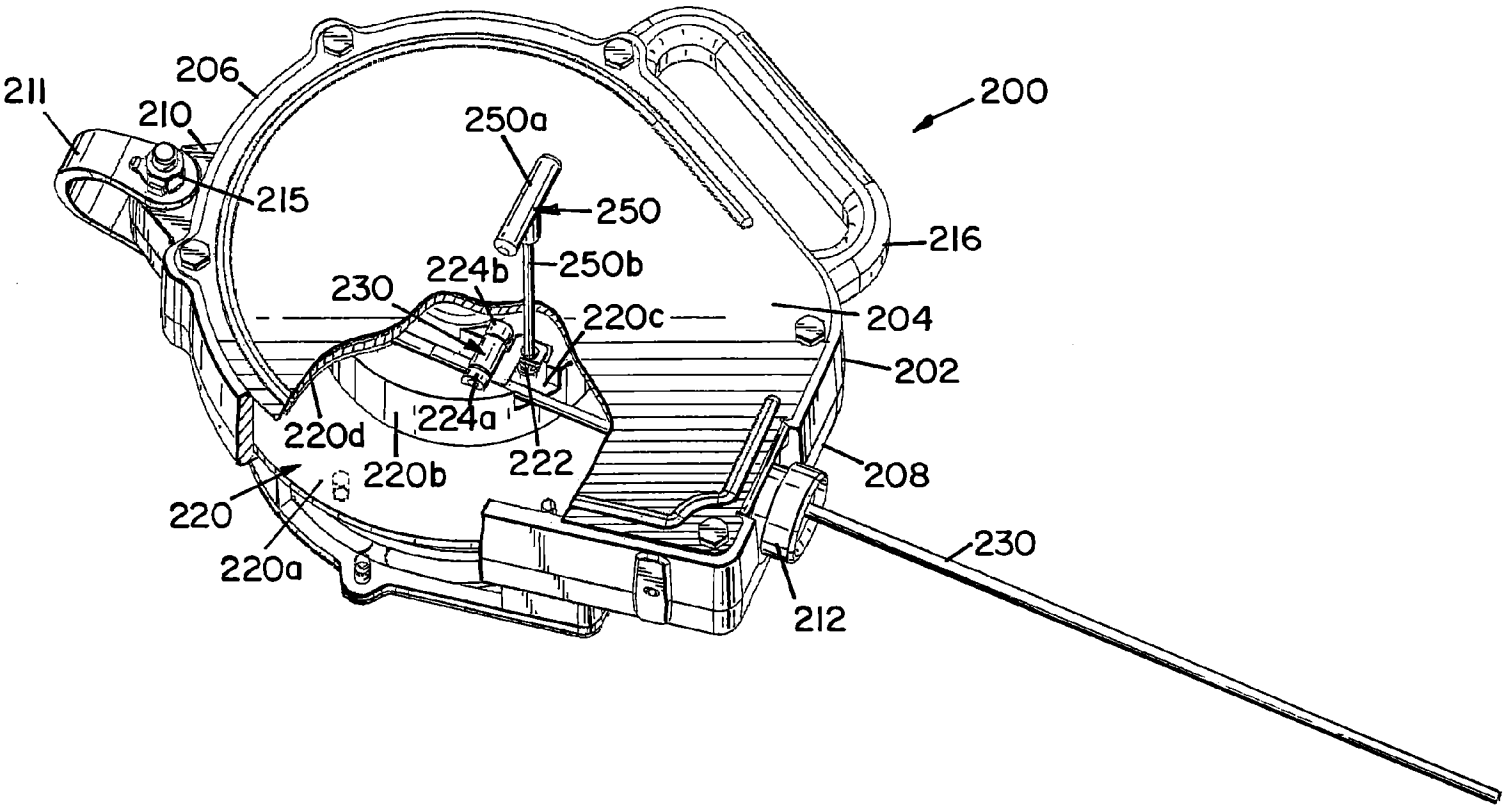
FIG. 6 is a front perspective view of a self-retracting lifeline of another embodiment of the present invention.

FIG. 6 illustrates a front perspective view of another embodiment of a self-retracting lifeline 200 with a lifeline 230 that can be disconnected. Self-retracting lifeline 200 includes a housing 202 and a housing cover 204 that is coupled to the housing 202. The housing 200 further has a handle 216 and a housing connecting portion 210 that is coupled proximate a top portion 206 of the housing 202. A support structure connector 211 is coupled to the housing connector portion 210 via fastener 215. The support structure connector 211 is used to couple to the self-retracting lifeline 200 to a support structure (not shown). The self-retracting lifeline 200 includes a drum 220 that is received in the housing 202. The drum 220 includes a first disc member 220*a*, a second disc member 220*d*, and a mid-member 220*b* that is coupled between the first disc member 220*a* and the second disc member 220*d*. The mid-member 220*b* includes a slot 220*c*. In this embodiment, a pawl 230 that is pivotally coupled to the drum 220 selectively retains the lifeline 230 to the drum 220. A tool 250 including a manipulation handle 250*a* and tool shaft 250*b* are used to manipulate a set screw 222. Set screw 222 is operationally coupled to the pawl 230 to selectively position the pawl 230 to selectively connect the lifeline 230 to the drum 220. Access to the drum 220 for the lifeline 230 is through cable guide 212 that is positioned in a bottom portion 208 of the housing 202.

Figure 7C:
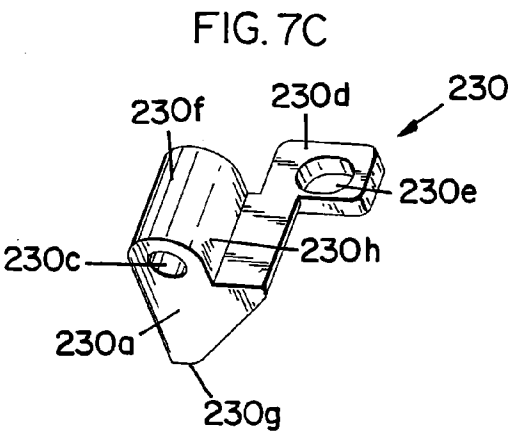
FIG. 7C is a side perspective view of the pawl of FIG. 7A.
Figure 7A:
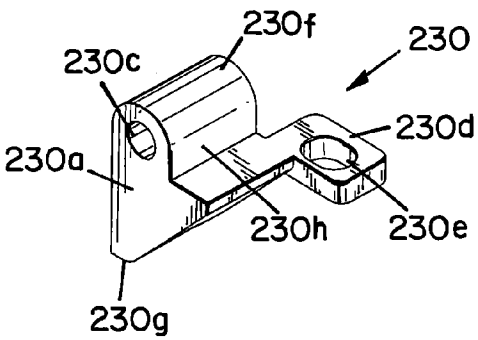
FIG. 7A is a front perspective view of a pawl of one embodiment of the present invention.
Figure 7B:
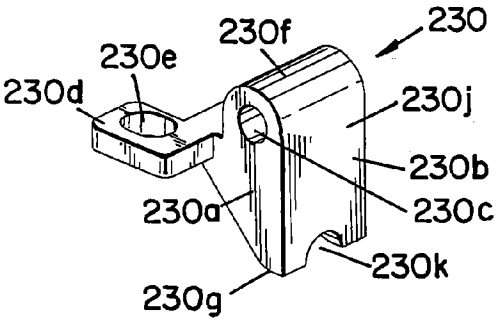
FIG. 7B is a back perspective of the pawl of FIG. 7A.

Illustrations of pawl 230 are shown in FIGS. 7A-7C. Pawl 230 includes a pawl based portion 230*a* having a first end 230*f* and second end 230*g*. A pawl connecting aperture 230*c* passes through the pawl base portion 230*a* proximate the first end 230*f* of the pawl base portion 230*a*. The pawl base portion 230*a* further includes a first side 230*h* and an opposed second side 230*j*. A pawl manipulation portion 230*d* extends from a mid-portion of the first side 230*h* of the base pawl portion 230*a*. The pawl manipulation portion 230*d* includes a pawl positioning aperture 230*e*. The pawl positioning aperture 230*e* is operationally coupled to the set screw 222. The second side 230*i* of the pawl based portion 230*a* includes an engaging surface 230*b* that is designed to engage a stop connector 232 that is coupled proximate an end of the lifeline 230 as illustrated below. The pawl base portion 230*a* further includes a lifeline notch 230*f* in the second end 230*g* of the pawl base portion 230*a*. The lifeline notch 230*k* is designed to receive a portion of the lifeline 230 when the engaging surface 230*b* is positioned to engage the stop connector 232.

Figure 8A:
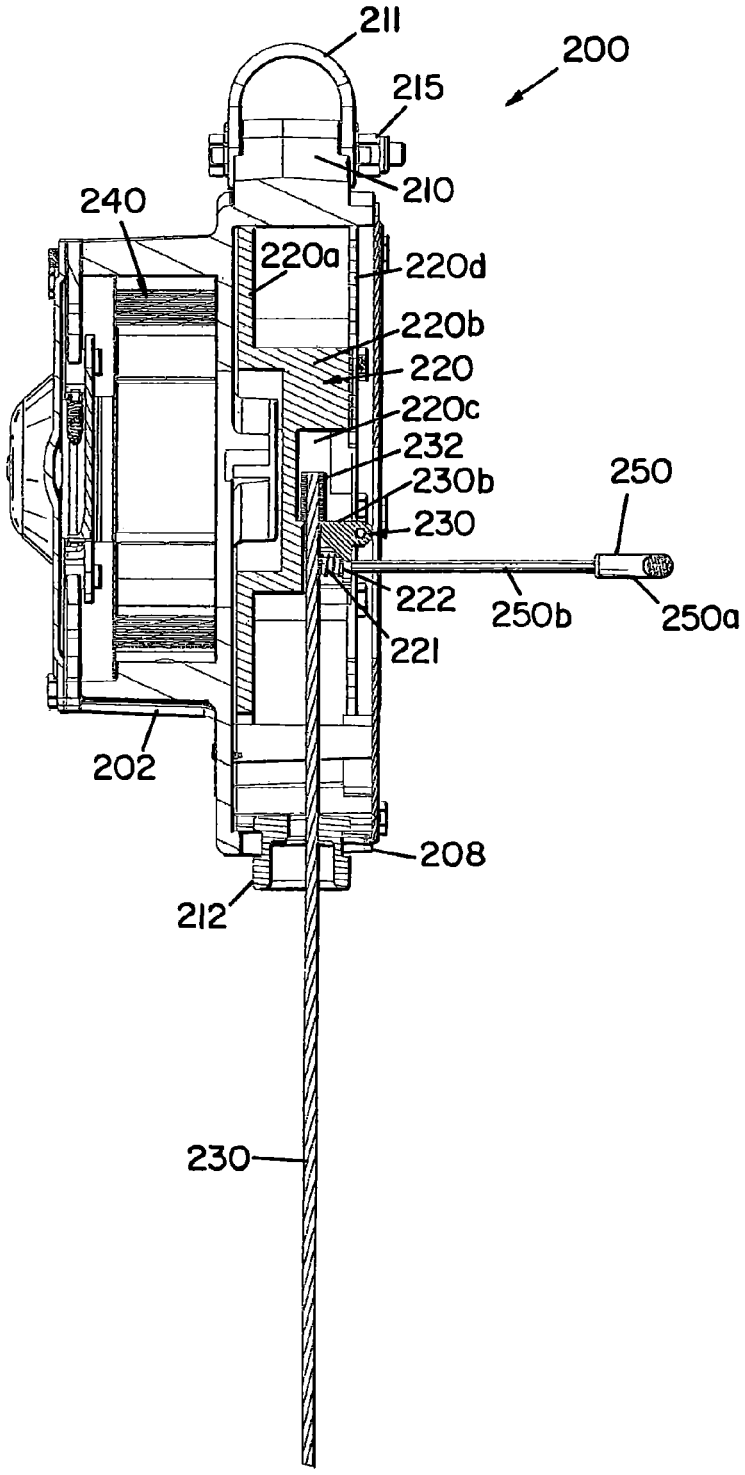
FIGS. 8A and 8B are cross-sectional side views of the self-retracting lifeline of FIG. 6 and an application of a tool of one embodiment of the present invention.
Figure 8B:
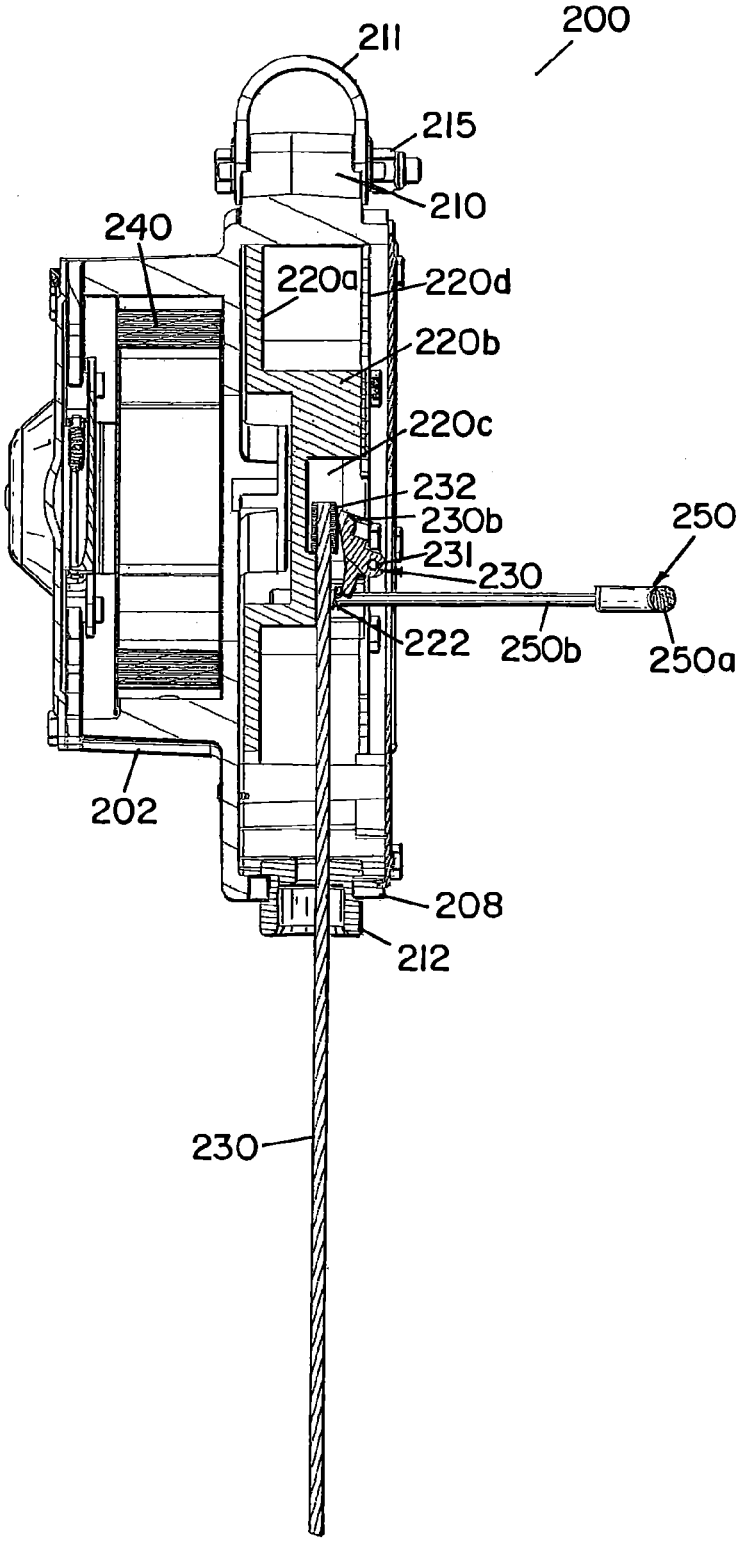

FIG. 8A illustrates a cross-sectional side view of self-retracting lifeline 200. In this illustration, the engaging surface 230*b* of pawl 230 is positioned to engage the stop connector 232 that is coupled proximate the end of the lifeline 230. As further illustrated, the tool shaft 250*b* has an engaging end that passes through a cover aperture in cover 204 to access set screw 222. Also illustrated in FIG. 8A is the activation assembly 240 that is also received in housing 202. The activation assembly 240 is operationally coupled to drum 220. Referring to FIG. 8B an illustration of pawl 230 in an unlocked position is provided. In particular, the cross-sectional view of the self-retracting lifeline 200 in FIG. 8B illustrates pawl 230 pivoted about pivot connection 231 such that the pawl engaging surface 230*b* does not engage the stop connector 232. The pawl 230 is manipulated into this position by the tool 250 engaging the set screw 222. The pawl 230 in the unlocked position allows the lifeline 230 to be removed from the drum 220 and replaced. In one embodiment, a compression spring 221 (shown in FIG. 8A) is positioned around the set screw 222. The compression spring 221 maintains the pawl 230 in a locked position, even if the set screw 222 is moved down. This embodiment prevents the unintentional disconnect of the lifeline 230 even if a user forgets to move the set screw 222 back up. This embodiment further provides an audio indication (clicking sound) when the pawl 230 enters into the locked position.

Figure 9B:
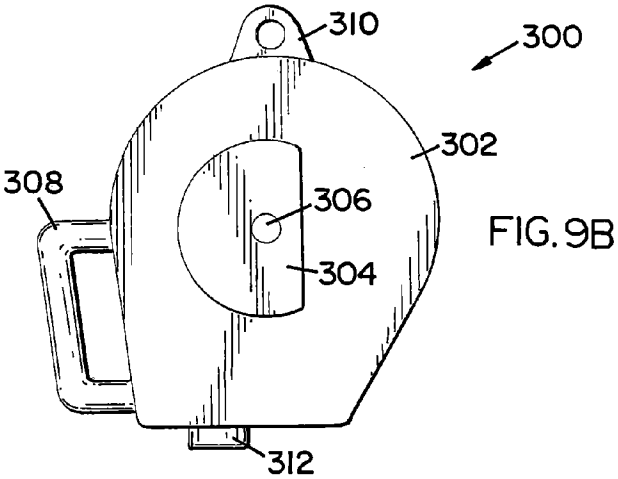
FIG. 9B is a front view of the self-retracting lifeline of FIG. 9A.
Figure 9A:
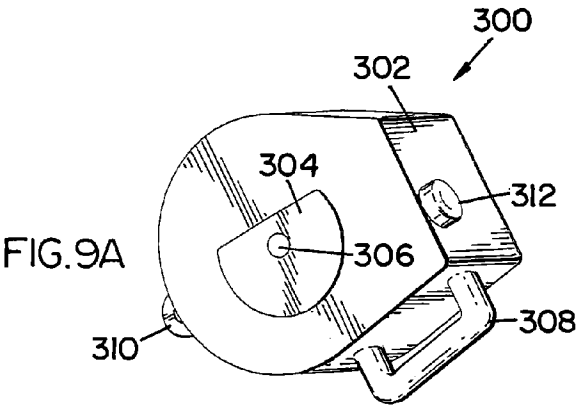
FIG. 9A is a front perspective view of a self-retracting lifeline of another embodiment of the present invention.
Figure 9C:
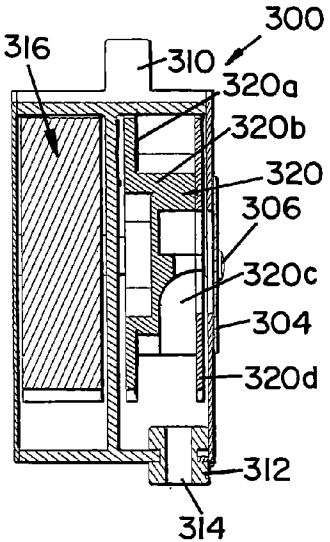
FIG. 9C is a cross-sectional side view of the self-retracting lifeline of FIG. 9A.

Another embodiment of a self-retracting lifeline 300 is shown in illustrations 9A-9C. In particular, FIG. 9A illustrates a front perspective view of self-retracting lifeline 300. As illustrated, the self-retracting lifeline 300 includes a housing 302, a handle 308, a housing connecting portion 310, and a cable guide 312. Also pivotally coupled about a pivot connection 306 to the housing 302 is an access cover 304. FIG. 9B illustrates a front view of the self-retracting lifeline 300 and FIG. 9C illustrates a cross-sectional side view of the self-retracting lifeline 300. As illustrated, the self-retracting lifeline 300 includes a drum 320 that is received in the housing 302. Drum 320 includes a first disc member 320*a* and a second disc member 320*d*. A mid-member 320*b* of the drum 320 is coupled between the first disc member 320*a* and the second disc member 320*d*. The mid-member 320*b* of the drum 320*b* includes a slot 320*c*. The cable guide 312 provides a passage 314 to the drum 320 upon which a lifeline (not shown in this illustration) is connected. The self-retracting lifeline 300 further includes an activation portion 316 that is operationally coupled to the drum 320.

Figure 10B:
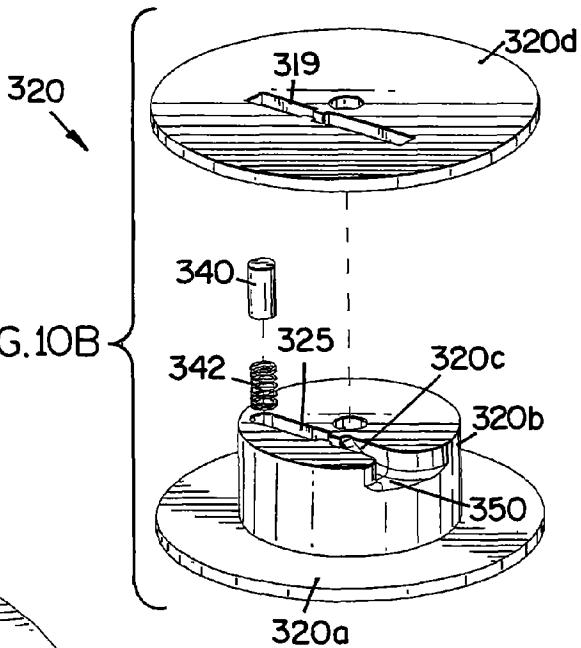
FIG. 10B is a side perspective view of a drum of one embodiment of the present invention including the drum portion of FIG. 10A.
Figure 10C:
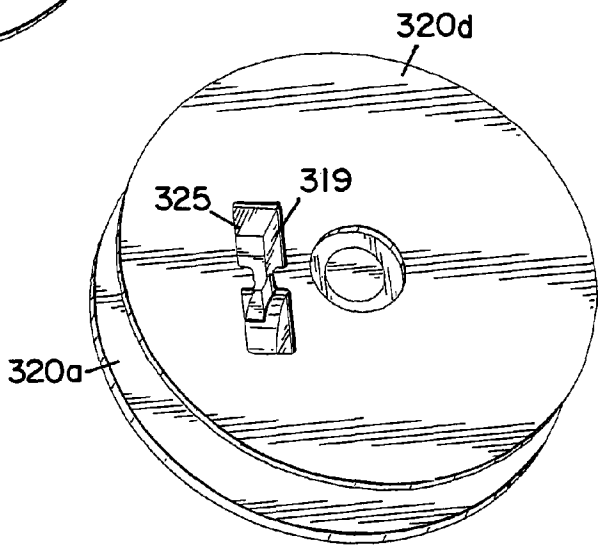
FIG. 10C is a front perspective view of the drum of FIG. 10B.
Figure 10A:
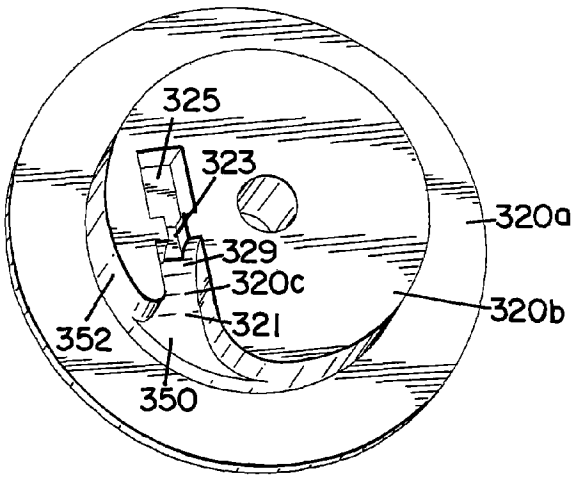
FIG. 10A is a front view of a portion of a drum of one embodiment of the present invention.

Referring to FIGS. 10A-10C an illustration of drum 320 is provided. In particular, FIG. 10A illustrates the first disc member 320*a* of the drum 320 and the mid-member 320*b* of the drum 320. As illustrated, the mid-member of the drum includes a slot 320*c*. Slot 320*c* includes a first slot portion 321, a second slot portion 323, and a third slot portion 325.

The first slot portion 321 provides an opening 350 to slot 320. The first slot portion 321 further includes a ramp surface 329. The third slot portion 325 is designed to receive a stop connector 332 coupled to an end of a lifeline 330. The second slot portion 323 that is positioned between the first slot portion 321 and the third slot portion 325 has a width that is less than the width of the first slot portion 321 and the third slot portion 325. Moreover, the width of the second slot portion 323 is slightly greater than the diameter width of the lifeline 330. FIG. 10A also illustrates the mid-member 320*b* having an outer surface 352 that it is designed to hold a lifeline 330. FIG. 10B illustrates the positioning of the second disc member 320*d* on the mid-member 320*b* of the drum 320. Moreover, FIG. 10B illustrates that the second disc member 320*d* includes a slot passage 319 that is aligned with slot 320*c*. FIG. 10B illustrates an embodiment with a locking member 340 and a locking biasing member 342 which is further described below. FIG. 10C further illustrates the assembled drum 320 having the slot passage 319 in the second disc member 320*d* aligned with the receiving slot 320*c* of the drum 320.

Figure 10E:
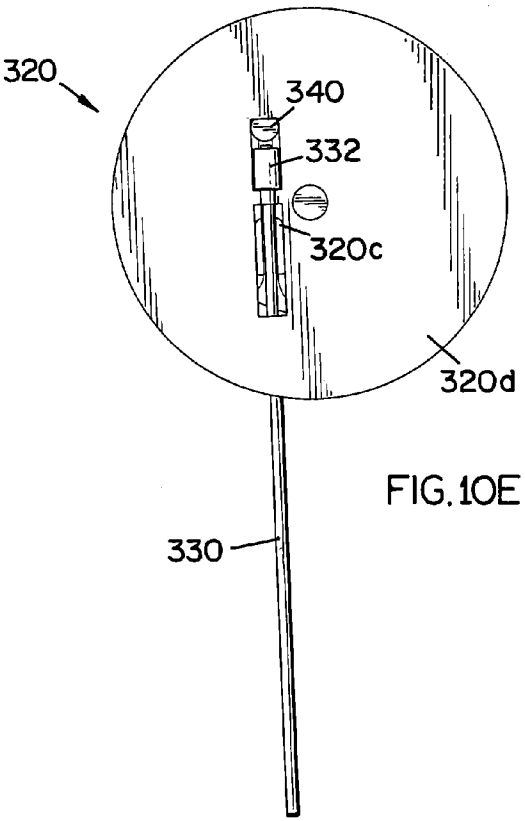
FIG. 10E is a top view of the drum and lifeline of FIG. 10D.
Figure 10F:
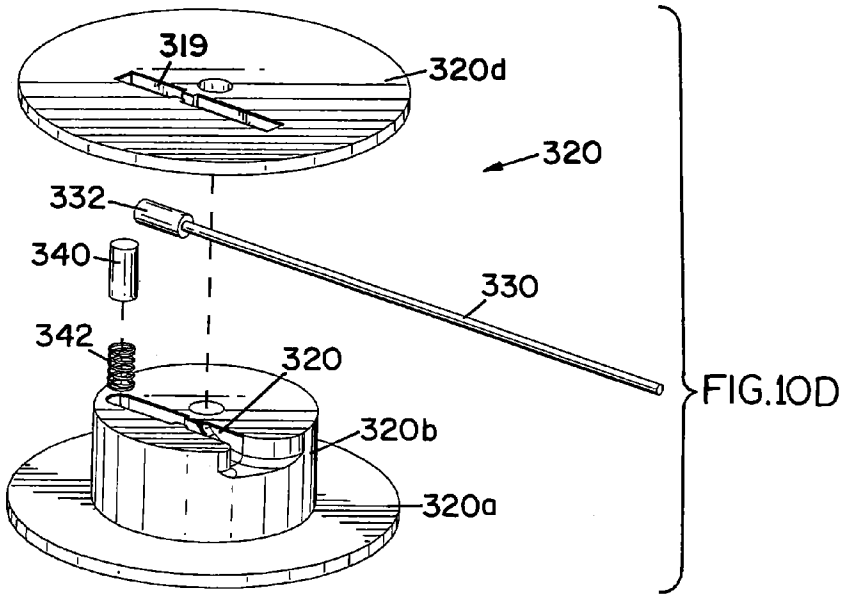
FIG. 10F is a cross-sectional side view of the drum and lifeline of FIG. 10D.
Figure 10F:
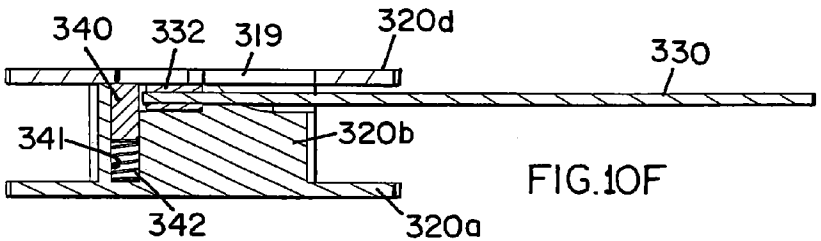

Referring to FIGS. 10D, 10E and 10F, a description of the use of the locking member 340 and locking biasing member 342 of the embodiment of FIG. 10B is provided. In particular, FIG. 10D illustrates an exploded side view of the drum 320, a lifeline 330 having a stop connector 332 and the locking member 340 and the locking biasing member 342. FIG. 10E illustrates a top view of the lifeline 330 connected to the drum 320 and FIG. 10F illustrates a cross sectional side view of the lifeline 330 connected to the drum 320. As illustrated, the locking biasing member 342 (which in this embodiment is a spring) is located in a bore 341 of the third slot portion 325 of receiving slot 320*c*. A first side of the locking member 340 abuts the locking biasing member 342 in the bore 341. A second end of the locking member 340 is forced into a portion of the upper disk 320*d* by the locking biasing member 342 as illustrated in FIGS. 10E and 10F. The locking member 340 prevents lateral movement of the stop connector 332 in the third slot portion 325 to prevent the lifeline 330 from getting inadvertently detached from the drum 320. To remove the lifeline 330 from the drum 320, or to insert a new lifeline 330 on the drum 320, a user simply presses down on the second end of the locking member 340 to compress the locking biasing member 342 thereby moving locking member 340 out of the way in the third slot portion 325.

Figures 11A, 11B, 11C:
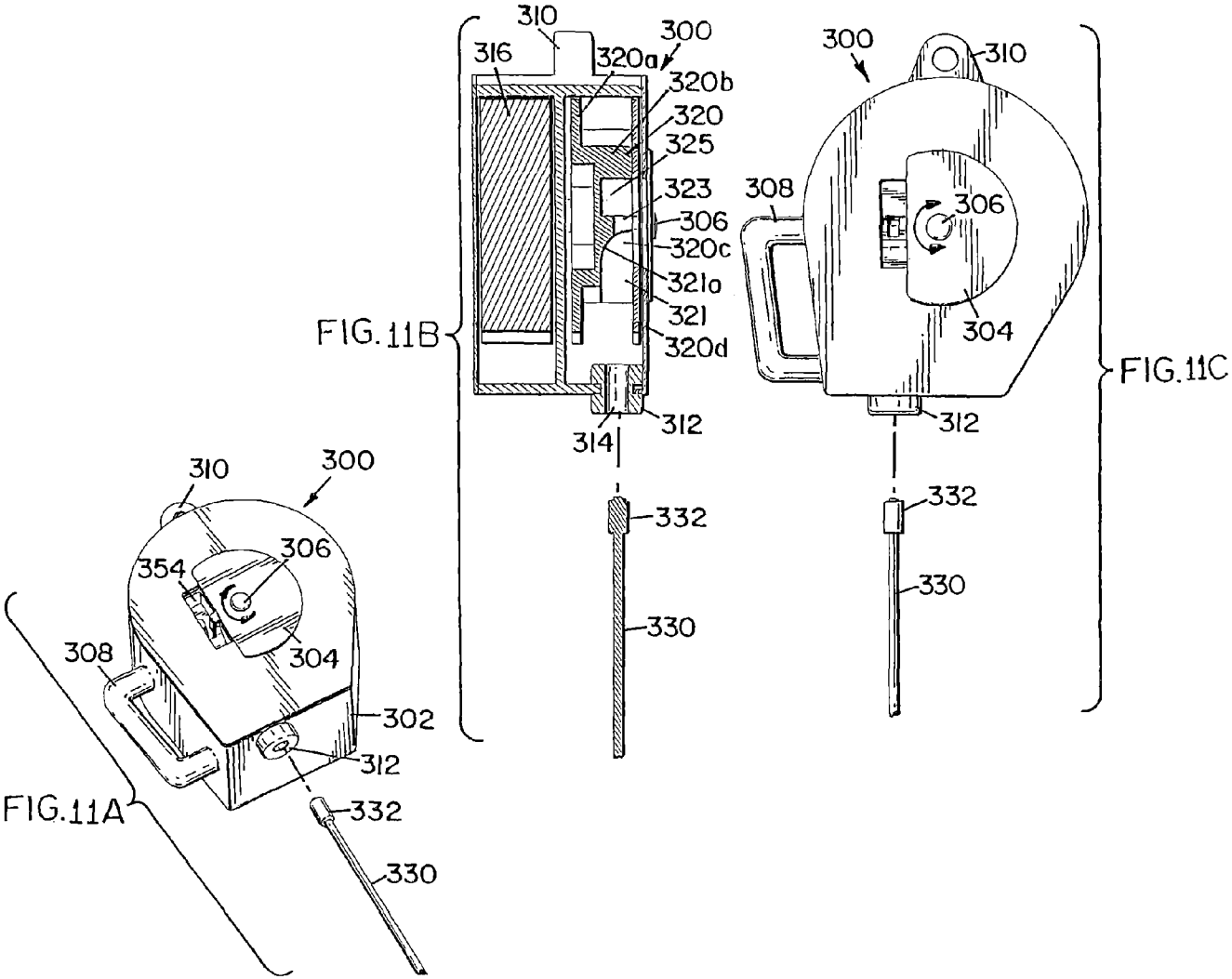
FIG. 11A is a front perspective view of the self-retracting lifeline of FIG. 9A with its access cover in an open position and lifeline of one embodiment of the present invention.
FIG. 11B is a cross-sectional side view of the self-retracting lifeline of FIG. 9A with its access cover in the open position and the lifeline.
FIG. 11C is a front view of the self-retracting lifeline of FIG. 9A with its access cover in an open position and the lifeline.
Figures 12A, 12B, 12C:
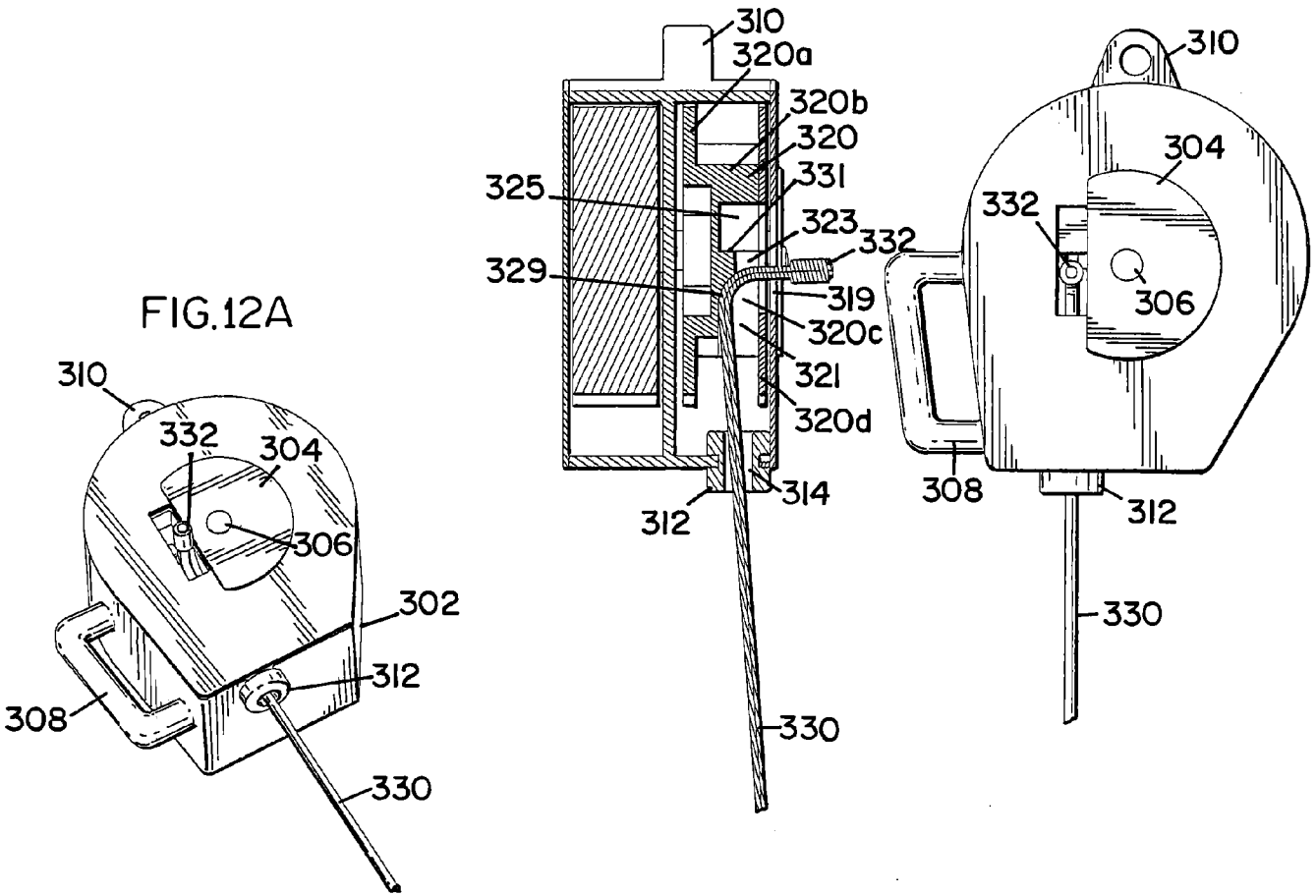
FIG. 12A is a front perspective view of the self-retracting lifeline of FIG. 9A with its access cover in an open position and a stop connector of the lifeline extending out of a housing access passage of one embodiment of the present invention.
FIG. 12B is a cross-sectional side view of the self-retracting lifeline of FIG. 9A with its access cover in the open position and the stop connector of the lifeline extending out of the housing access passage.
FIG. 12C is a front view of the self-retracting lifeline of FIG. 9A with its access cover in an open position and the stop connector of the lifeline extending out of the housing access passage.
Figure 13C:
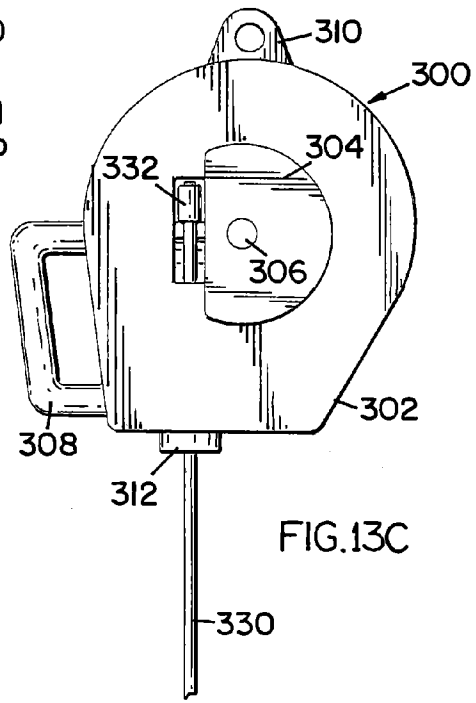
FIG. 13C is a front view of the self-retracting lifeline of FIG. 9A with its access cover in an open position and the stop connector of the lifeline positioned in the slot of the drum.
Figure 13B:
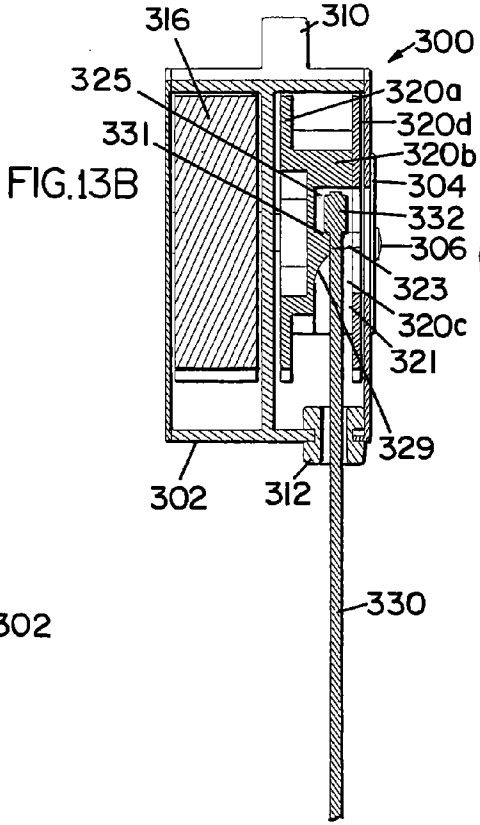
FIG. 13B is a cross-sectional side view of the self-retracting lifeline of FIG. 9A with its access cover in the open position and the stop connector of the lifeline positioned in the slot of the drum.
Figure 13A:
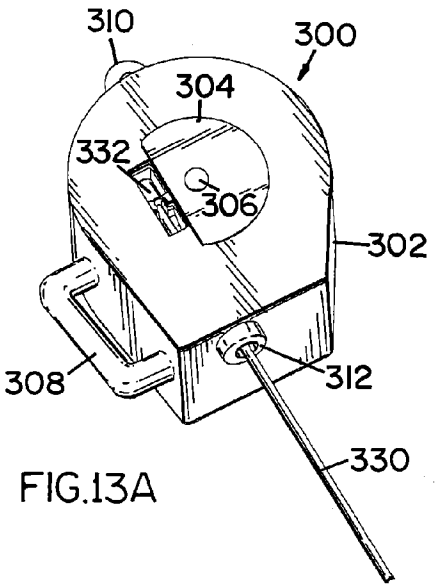
FIG. 13A is a front perspective view of the self-retracting lifeline of FIG. 9A with its access cover in an open position and the stop connector of the lifeline positioned in a slot in the drum of one embodiment of the present invention.
Figure 14C:
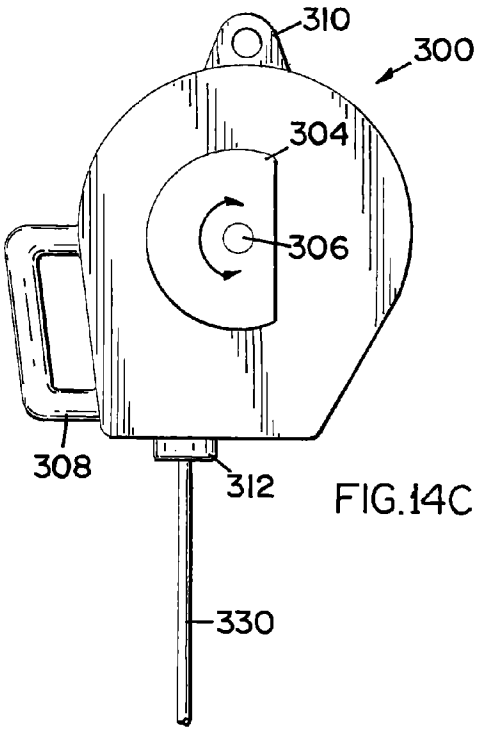
FIG. 14C is a front view of the self-retracting lifeline of FIG. 9A with its access cover in the closed position and the lifeline attached.
Figure 14B:
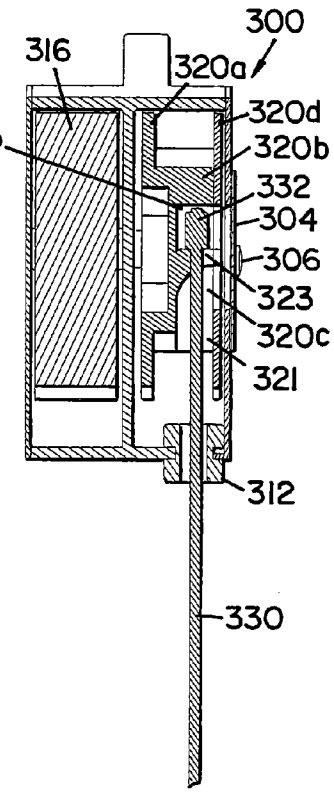
FIG. 14B is a cross-sectional side view of the self-retracting lifeline of FIG. 9A with its access cover in the closed position and the lifeline attached.
Figure 14A:
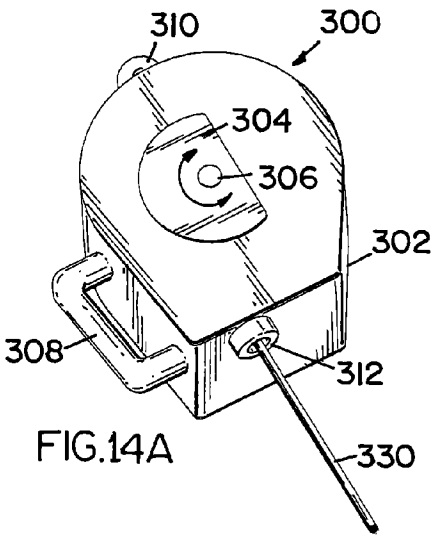
FIG. 14A is a front perspective view of the self-retracting lifeline of FIG. 9A with the lifeline attached and its access cover in a closed position of one embodiment of the present invention.

FIGS. 11A-11C illustrates the self-retracting lifeline 300 and a lifeline 330. In particular, FIGS. 11A-11C illustrates the positioning of lifeline 330 in relation to the self-retracting lifeline 300. As illustrated, the lifeline 330 includes the stop connector 332 that is coupled proximate an end of the lifeline 330. In FIG. 11A the housing cover 304 is pivoted about pivot connection 306 to be in an open position. In the open position, a housing access passage 354 through the housing 302 is exposed. The housing access passage 354 provides a path to the slot passage 319 and the receiving slot 320*c* of the drum 320. In the cross-sectional side view of FIG. 11B an illustration of how the stop connector 332 of the lifeline is aligned with passage 314 through cable guide 312 into the first slot portion 321 of the slot 320*c* of the drum 320 is provided. FIGS. 12A-12C illustrate the stop connector 332 coupled proximate the end of the lifeline 330 in a first position when initially inserted through the passage 314 in the cable guide 312 and into the first slot portion 321. In particular, as the stop connector 332 of the lifeline 330 is being positioned in the first slot portion 331 it engages ramp surface 329 of the slot 320*c*. Ramp surface 329 guides the stop connector 332 out of the slot 320*c*, through the slot passage 319 of the second disc 320*d* and through the housing access passage 354. In this first position, a user can grasp the stop connector 332. The stop connector 332 is then positioned by the user in the third slot portion 325. This is illustrated in FIGS. 13A-13C. In this position the stop connector 332 engages an engaging surface 331 in the third slot portion 325. Since the second slot portion 323 has a width that is less than the third slot portion 325 and slightly greater than the diameter width of the lifeline 333, the stop connector 332 cannot pass through the second slot portion 323. Hence, in this second position the stop connector 332 couples the lifeline 330 to the drum 320. Once the stop connector has been positioned in the third slot portion 325 the access cover 304 of the housing is pivoted about pivot connection 306 to cover the housing access passage 354. Besides covering the stop connector 332 in the third slot portion 325 the access cover 304 further prevents the stop connector 332 from being inadvertently slid out of the third slot portion 325. Illustrations of the housing access cover 304 in the closed position are shown in FIGS. 14A-14C. In removing a lifeline 330 from the self-retracting lifeline 300 the access cover 304 is simply placed in the open position where a user can access the stop connector 332 and selectively remove it out of slot 325. The user can then simply pull on the lifeline 320 to remove it from the drum 320. Hence the self-retracting lifeline 300 provides another embodiment where a worn lifeline 330 can be replaced.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

The invention claimed is:

1. A self-retracting lifeline comprising:

a housing;

a drum received in the housing, the drum having a threaded bore;

an activation assembly received in the housing, the activation assembly operationally coupled to the drum;

a lifeline;

a connector coupled proximate an end of the lifeline, the connector having a connector passage, the connector passage configured and arranged to selectively couple the lifeline to the drum; and a set screw received in the threaded bore, the set screw further selectively received in the connector passage of the connector to couple the lifeline to the drum;

a housing cover coupled to the housing, the housing cover having an access aperture configured and arranged to allow access to a manipulation end of the set screw via a tool;

wherein the drum further comprises:

a first disk member;

a second disk member, the second disk member having a second disk member access aperture configured and arranged to allow access to the manipulation end of the set screw; and a mid-member positioned between the first disk member and the second disk member, the mid-member including a slot, the slot configured and arranged to receive the connector and a portion of the lifeline proximate the connector.

2. The self-retracting lifeline of claim 1, further comprising:

the tool configured to manipulate the set screw to selectively couple the lifeline to the drum.

3. The self-retracting lifeline of claim 1, wherein the connector further comprises:

a neck coupled to the end of the lifeline; and a head extending from the neck, the connector passage passing through the head.

4. A self-retracting lifeline comprising:

a housing;

a drum received in the housing;

an activation assembly received in the housing, the activation assembly operationally coupled to the drum, the drum having a threaded bore;

a lifeline;

a connector coupled proximate an end of the lifeline, the connector having a connector passage; and a set screw received in the threaded bore, the set screw further selectively received in the connector passage of the connector to couple the lifeline to the drum;

a housing cover coupled to the housing, the housing cover having an access aperture configured and arranged to allow access to a manipulation end of the set screw via a tool;

wherein the drum further comprises:

a first disk member;

a second disk member, the second disk member having a second disk member access aperture configured and arranged to allow access to the manipulation end of the set screw; and a mid-member positioned between the first disk member and the second disk member, the mid-member including a slot, the slot configured and arranged to receive the connector and a portion of the lifeline proximate the connector.

5. The self-retracting lifeline of claim 4, further comprising:

the tool configured to manipulate the set screw to selectively couple the lifeline to the drum.

6. The self-retracting lifeline of claim 4, wherein the connector further comprises:

a neck coupled to the end of the lifeline; and a head extending from the neck, the connector passage passing through the head.

* * * * *